US007244220B2

(12) United States Patent
Carney

(10) Patent No.: US 7,244,220 B2
(45) Date of Patent: Jul. 17, 2007

(54) EXERCISE LOG

(75) Inventor: John M. Carney, Encinitas, CA (US)

(73) Assignee: JMC Ventures LLC, Encinitas, CA (US)

( * ) Notice: Subject to any disclaimer, the term of this patent is extended or adjusted under 35 U.S.C. 154(b) by 418 days.

(21) Appl. No.: 10/999,035

(22) Filed: Nov. 29, 2004

(65) Prior Publication Data

US 2006/0116256 A1 Jun. 1, 2006

(51) Int. Cl.
*A63B 21/075* (2006.01)

(52) U.S. Cl. ..... 482/106; 482/126; 482/108

(58) Field of Classification Search ..... 482/104–108, 482/148, 126, 92–94, 109, 83, 141, 907
See application file for complete search history.

(56) References Cited

U.S. PATENT DOCUMENTS 660,962 A * 10/1900 Kennedy ..... 482/108
4,029,312 A * 6/1977 Wright ..... 482/108
4,854,575 A * 8/1989 Wilson et al. ..... 482/108
7,090,625 B2 * 8/2006 Chermack ..... 482/108

OTHER PUBLICATIONS

Encyclopedia of Indian Culture Sree Ramm Vijaya Printing Press 1950 pp. 566-601. Nos. 1156-1157.*

* cited by examiner

*Primary Examiner*—Jerome Donnelly
(74) *Attorney, Agent, or Firm*—Pattric J. Rawlins; Procopio Cory Hargreaves & Savitch LLP

(57) ABSTRACT

An exercise device providing an exterior sheath for a standard Olympic weight bearing bar that secures the bar and weight while providing access to the bar for gripping and also providing secure handles which are perpendicular to the bar and parallel to the torso, providing alternate gripping posture for alternate exercise paradigms.

18 Claims, 2 Drawing Sheets

EXERCISE LOG

BACKGROUND

1. Field of the Invention

The present invention relates to the field of physical exercise equipment.

2. Related Art

Physical exercise has many benefits. For a complete and well rounded exercise program many believe each muscle must be exercised, often called isolating on that muscle. Numerous exercises have been developed which isolate each muscle and muscle group. A pervasive aspect of all exercise is the weight bar or the resistance applied to the muscle. This invention is directed to an improved weight bar useful in physical exercise.

The development of the human bicep is an important part of the art of body building, particularly to the novice. The exercise normally practiced for building the biceps involves "curling". The curling exercise is performed by grasping a weighted bar with each hand and curling the forearm upwardly and back toward the upper arms. Importantly, it is often through isolating on a particular muscle or muscle group, that proper exercise of the muscle or muscle group is accomplished.

The several variations of the press, including military, bench, power and so on, represent exercises for the deltoid, triceps, pectorals and other minor muscles involved in shoulder movement. The bench press is a well known exercise involving laying on ones back, grasping the weight bar with both hands and lowering the bar towards the chest, followed by extending the arms away from the chest. Another type of press is performed in a sitting position with the arms straight over the head, holding the weight bar with both hands. The exercise involves bending at the elbow and lowering the bar to about the chest level and then raising the bar back to full extension of the arms.

The development of the leg through the lunge and deep-knee type exercise are likewise important aspects of exercising the muscle groups of the leg.

Various types of weightlifting apparatuses have been proposed in the past to increase the effectiveness of the these and related exercises. One such device is disclosed in U.S. Pat. No. 3,384,370 to Bailey et al. The Bailey device consists of an essentially straight bar having conventional weights mounted on the opposite extremities thereof. A pair of spaced apart rings are secured to the bar, intermediate the extremities thereof. Handles are rotatably mounted within the rings to allow turning of the wrists during the curl. It is well known that twisting of the wrists during a curl provides increased exercise of the forearms as well as additional development of the biceps.

The Bailey device possesses a number of shortcomings, however, which have prevented its acceptance and use by body builders. One of the disadvantages of this device relates to the fact that the handles are rotatably mounted within the rings. This construction is rather unstable and presents the opportunity for fingers and items of clothing to become pinched between the rollers which mounts the handles on the rings. The rings themselves are quite heavy and rather bulky in order to provide sufficient strength to allow the weights to be mounted in cantilever fashion directly thereon. In fact, it has been found that this construction is rather weak because of the fact that the various sections of the bar must be secured to the rings by a series of welds which are constant shear bearing.

Additional exercise devices are disclosed in U.S. Pat. No. 6,022,300, to Hightower which discloses a rotating grip barbell device.

A disadvantage of the Bailey and Hightower devices lies in the fact that the handles may be turned independently. This arrangement tends to promote uneven development of the muscles since the handles associated with the stronger arm may turn at a different rate or magnitude than the rings associated with the weaker arm. The assumed goal, which was neither stated nor accomplished was to provide a more natural gripping orientation during exercise.

Further disadvantages of exercise devices in the art relate to awkward hand positioning and substantial discomfort caused by the bar resting on the back or shoulders during leg exercises.

There is need, therefore, for an improved exercise device directed to these and other issues.

SUMMARY

The present exercise bar provides two alternate gripping paradigms, depending on the exercise paradigm desired. The present exercise device provides two sets of handles which are perpendicular to the standard weight bar and the ground while parallel to the user's torso. This new handle orientation allows additional exercise focus, muscle isolation and comfort. Additionally, the present exercise device also allows gripping of the bar according to standard orientation. The two sets of vertical handles further facilitates additional exercises which may require a more obtuse angle between the arms and the chest. Exercises that benefit from moving the arms more laterally, before commencing the desired motion, are also facilitated.

In brief, the exercise device comprises an elongated substantially cylindrical exercise device having a continuous side exterior surface, an interior surface, an interior portion, opposite end portions, a continuous middle exterior portion a first handle access portion and a second handle access portion between the middle portion and one end portion, defining a handle side of the exercise device, a first bar access portion and a second bar access portion between the middle portion and one end portion, defining a bar side of the exercise device;

a first gripping handle and a second gripping handle each fixedly attached to the interior surface at the first handle access portion, each gripping handle perpendicularly disposed to the exercise device;

a third gripping handle and a forth gripping handle each fixedly attached to the interior surface at the second handle access portion, each gripping handle perpendicularly disposed to the exercise device;

an elongated exercise bar releasably secured within the interior portion having a first and second end for receiving and securing circular weight plates thereon;

a first and a second securing means for releasably securing the exercise bar within the interior portion.

An additional aspect of the exercise device according to the present invention is directed to a weightlifting exercise device for use in an exercise regimen for increasing muscular strength, the weightlifting device comprising:

an elongated tubular substantially cylindrical exercise device having an exterior surface, an interior surface which surrounds and defines, an interior area, securing means fixedly attached to the interior surface, opposite end portions, a continuous middle exterior portion a first top open portion and a first back open portion between the middle portion and one end portion, a second top open portion and a second back open portion between the middle portion and one end portion, where the first top open portion and the second top open portion, together define a handle gripping side and the first back open portion and the second back open portion define a bar gripping side;

a first gripping handle and a second gripping handle each fixedly attached to the interior surface at the first top open portion, each gripping handle perpendicularly disposed to the exercise device;

a third gripping handle and a forth gripping handle each fixedly attached to the interior surface at the second top open portion, each gripping handle perpendicularly disposed to the exercise device;

an elongated exercise bar releasably secured by the securing means within the interior area, the exercise bar having a first and second end for receiving and securing circular weight plates thereon;

a first and a second securing means for releasably securing the circular weight plates.

BRIEF DESCRIPTION OF THE DRAWINGS

The details of the present invention, both as to its structure and operation, may be gleaned in part by study of the accompanying drawings, in which like reference numerals refer to like parts, and in which.

Similar reference characters denote corresponding features consistently throughout the attached Figures.

DETAILED DESCRIPTION

Figure 1:
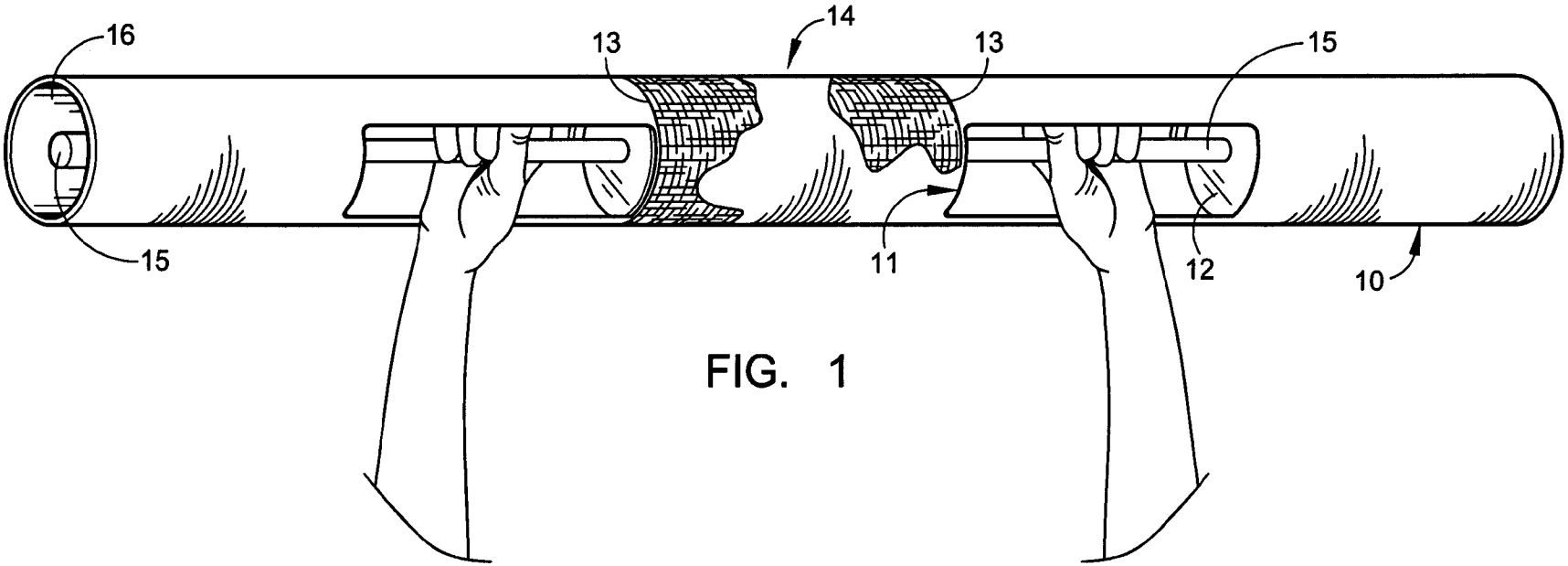
FIG. 1 is a perspective view of the exercise log according to one aspect of the present invention, showing the bar access side.
Figure 2:
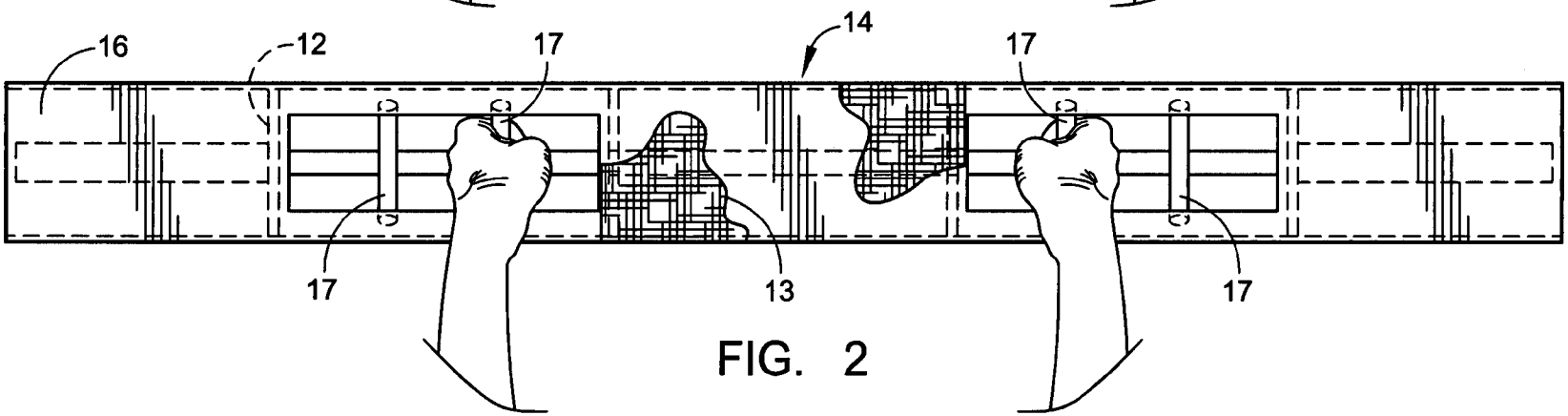
FIG. 2 is another view of the exercise bar, showing the handle access side thereof.

The present invention described herein is shown primarily in FIGS. 1 and 2. In these two figures are demonstrated related, yet dissimilar exercise paradigms. FIG. 1 depicts a standard barbell 15 passing lengthwise down the interior area 16 of the exercise device 10. The exercise device 10 is preferably a hollow cylinder capable of receiving a standard weight bar and securing the bar with or without optional weight plates placed on the bar) within the device 10. The inner diameter of the device 10 may be of any size adapted to the diameter of circular weight plates intended to fit therein, but is preferably large enough to receive standard 10 pound weight plates. Alternative diameters may also be employed to receive up to standard 45 pound weight plates.

Standard weights as known in the art may be fitted over the weight bar 15 and moved along the shaft towards the center and the interior collar of the weight bar (not shown). An exterior collar (not shown) may then be placed on the bar 15 to secure the weights onto the bar. The stop 12 is preferably an internal barrier within the device 10 that allows an end of the weight bar to pass through but prevents the entire weight bar from passing through the interior area 16. For example, standard weight bars typically include an integral interior collar device (not shown) that is used to prevent weights from moving toward the gripping area of the bar 15. This collar device is larger than the gripping area of the bar and also larger than the portion of the bar where the weights are placed. The stop 12 is preferably configured to allow the portion of the bar where the weights are placed to pass through while preventing the larger interior collar of the weight bar from passing through. In this fashion, one end of the weight bar is secured within the device 10.

To secure the weight bar from moving within the device 10, a similar stopping mechanism (not shown) may also be employed on the opposing end of the device 10. The opposing stopping mechanism may one or more of a latch, pin, screw, bolt, turnkeys, clamp, pin, sliding wall, or other conventional mechanical stopping means known in the art or some combination thereof. The function of the opposing stopping mechanism is to secure the weight bar within the interior area 16 of the device 10 such that the weight bar is prevented from movement. The opposing stopping mechanism may pass through the exterior surface of the device 10 or may be engaged through the bar access portion 11.

In an alternative embodiment, the stop 12 may also be implemented as a stopping mechanism other than an interior wall. However, the combination of the stop 12 and the opposing stop mechanism should function to secure the weight bar 15 within the device 10 during use of the device 10.

The user may engage in standard weight lifting-type exercises by grabbing the bar 15 through bar access portions 11 through the exterior surface 14. Optional surface 13, which may be a synthetic material such as rubber, may be placed over exterior surface 14 to facilitate the placing of the exercise device 10 on one's shoulders or back, for exercises such as the lunge, for example.

FIG. 2 presents the use with four gripping handles 17 which may be accessed through handle access portions 11. Preferably, the gripping handles 17 are placed on the opposite side of the device 10 from the bar access portion 11. Handles 17 are integral with the exercise device 10 and preferably perpendicular to the weight bar 15 within the device 10 in order to provide the ability to exercise according to an alternative gripping paradigm. Handles 17 may also be oriented at alternative angles relative to the weight bar, for example at a forty-five degree angle to facilitate a more natural wrist position during a curling exercise.

In one embodiment, a dimple (not shown) is placed within the exterior surface of the device 10 and one or more handles 17 are extended across the dimple such that the dimple provides enough room for gripping the handle 17 but does not extend through the exterior surface 14 of the device 10 to provide access to the bar 15. A user may then engage in standard weight lifting-type exercises by grabbing the handles 17.

Figure 3:
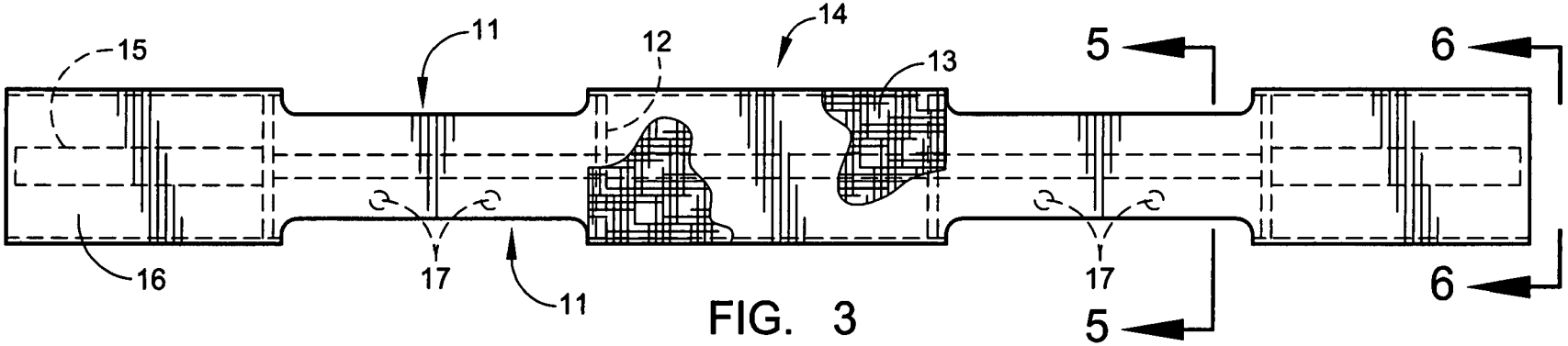
FIG. 3 is a top view showing the bar access and the handle access portions.

FIG. 3 represents a top view showing the relationship between the handle and bar access portions 11, being on opposite sides of the exercise device 10. This spatial relationship may be further understood by noting vertical handles 17 which may be accessed through the handle access portion 11. The standard type weight bar 15 may be alternatively accessed through bar access portion 11. In an alternative embodiment, the handle access portion 11 may be a dimple that does not provide access through the exterior surface 14 to the weight bar 15.

Figure 4:
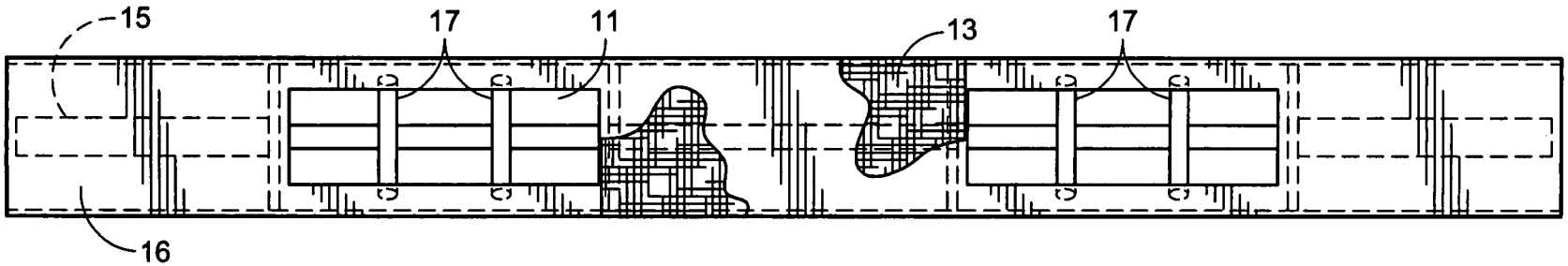
FIG. 4 is a cut-away view from the handle side.

FIG. 4 is a partial cut-away view of the exercise device 10 from the side where the handles 17 are located. Again, the handle access portion 11 (as opposed to the bar access portion) may be a dimple that does not provide access through the exterior surface 14 to the weight bar 15.

Figure 5:
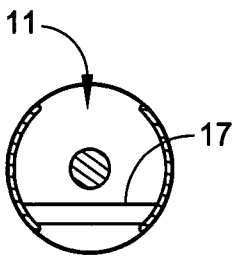
FIG. 5 is an end-on view taken along line 5 of FIG. 3.
Figure 6:
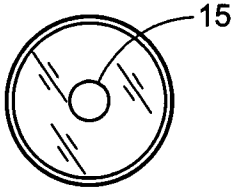
FIG. 6 is an end-on view taken along line 6 of FIG. 3.

FIG. 5 is an end-on cross section view, cut across line 5 of FIG. 3. This figure demonstrates the relationship between the handle and bar access portions 11, which are found between middle portion 14 and end portions. This figure further exemplifies one preferred embodiment of the exercise device 10 where the bar access portion 11 and the handle access portion 11 are juxtaposed on opposing sides of the device 10. Although depicted herein, the handle access portion and the bar access portions may have any alternate spatial relationship, based on desire and anticipated exercise paradigm. Furthermore, the handle 17 is illustrated as being integral to the device 10 such that even when the device 10 is not engaged with a weight bar 15, the device 10 may be picked up using the handles 17.

The handles 17 and the bar 15 may further have a knurled or ridged surface (not shown) for increased or improved grasping ability. The handles 17 can be provided at locations that re more inner and more outer to the center of the exercise device 10. A user may elect to grasp inner handles 17 for over the head press, yet use outer handles 17 for deep-knee or lunge exercises. The orientation of the handles 17 may be perpendicular to the weight bar or at an angle other than ninety degrees. During exercise, it may be advantageous to rest the exercise device 10 on the shoulders or back according to middle portion 14, which may have optional covering 13 made of a material that is preferably both comfortable to the skin and durable.

The handles 17 may be used to grip the exercise device 10 in performing any exercise. The perpendicularly disposed handles provide an alternate exercise paradigm where the hands are gripping in a fashion which is substantially parallel to the torso. Alternative angles and location of the handles 17 may also be employed. Through these alternate handle positions and angles, isolation of muscle groups is made available through standard exercises.

Additionally, the use of handles 17 facilitates performance of standard exercises, such as the bench and military press without placing substantial pressure on the weightlifter's wrist. Through this exercise paradigm, wrist and elbow movements are more natural and thereby less stressful to the corresponding joints.

It is to be understood that the present invention is not limited to the embodiments described above, but encompasses any and all embodiments within the scope of the following claims.

What is claimed is:

1. An exercise device comprising:

(a) an elongated substantially cylindrical exercise device having a continuous side exterior surface, an interior surface, an interior portion, opposite end portions, a continuous middle exterior portion a first handle access portion and a second handle access portion between said middle portion and one end portion, defining a handle side of said exercise device, a first bar access portion and a second bar access portion between said middle portion and one end portion, defining a bar side of said exercise device;

a first gripping handle and a second gripping handle each fixedly attached to said interior surface at said first handle access portion, each gripping handle perpendicularly disposed to said exercise device;

a third gripping handle and a forth gripping handle each fixedly attached to said interior surface at said second handle access portion, each gripping handle perpendicularly disposed to said exercise device;

(b) an elongated exercise bar releasably secured within said interior portion having a first and second end for receiving and means for securing circular weight plates thereon;

(c) at least a first securing means for releasably securing said exercise bar within said interior portion.

2. The exercise device according to claim 1 wherein the securing means are selected from the group consisting of screws, bolts, turnkeys, clamps and pins.

3. The exercise device according to claim 1 wherein the weight plates are secured on the exercise bar within the interior portion.

4. The exercise device according to claim 1 wherein the first bar access portion and the second bar access portion are substantially rectangular allowing gripping the exercise bar there through.

5. The exercise device according to claim 1 wherein the first handle access portion and the second handle access portion are substantially rectangular allowing gripping of the handles there through.

6. The exercise device according to claim 1 further comprising a removeable exterior layer of substantially similar shape and dimension of the exercise device.

7. The exercise device according to claim 6 wherein the exterior layer is composed of a pliable material.

8. The exercise device according to claim 7 wherein the pliable material is synthetic.

9. The exercise device according to claim 7 wherein the pliable material is natural.

10. A weightlifting exercise device for use in an exercise regimen for increasing muscular strength, said weightlifting device comprising:

(a) an elongated tubular substantially cylindrical exercise device having an exterior surface, an interior surface which surrounds and defines, an interior area, at least one securing means fixedly attached to said interior surface, opposite end portions, a continuous middle exterior portion a first top open portion and a first back open portion between said middle portion and one end portion, a second top open portion and a second back open portion between said middle portion and one end portion, where the first top open portion and the second top open portion, together define a handle gripping side and the first back open portion and the second back open portion define a bar gripping side;

a first gripping handle and a second gripping handle each fixedly attached to said interior surface of said first top open portion, each gripping handle perpendicularly disposed to said exercise device;

a third gripping handle and a forth gripping handle each fixedly attached to said interior surface of said second top open portion, each gripping handle perpendicularly disposed to said exercise device;

(b) an elongated exercise bar releasably secured by said securing means within said interior area, said exercise bar having a first and second end for receiving and means for securing circular weight plates thereon.

11. The exercise device according to claim 10 wherein the securing means are selected from the group consisting of screws, bolts, turnkeys, clamps and pins.

12. The exercise device according to claim 10 wherein the weight plates are secured on the exercise bar within the interior area.

13. The exercise device according to claim 10 wherein the first and second back open portions are substantially rectangular allowing gripping the exercise bar there through.

14. The exercise device according to claim 10 wherein the first and second top open portions are substantially rectangular allowing gripping of the handles there through.

15. The exercise device according to claim 10 further comprising a removeable exterior layer of substantially similar shape and dimension of the exercise device.

16. The exercise device according to claim 15 wherein the exterior layer is composed of a pliable material.

17. The exercise device according to claim 16 wherein the pliable material is synthetic.

18. The exercise device according to claim 16 wherein the pliable material is natural.

* * * * *